US010184476B2

(12) United States Patent
Sanders et al.

(10) Patent No.: US 10,184,476 B2
(45) Date of Patent: Jan. 22, 2019

(54) METHOD OF DETERMINING HYDRAULIC OPERATING POINT OF A PUMP

(71) Applicant: WILO SE, Dortmund (DE)

(72) Inventors: Tilmann Sanders, Dortmund (DE); Jens Fiedler, Dortmund (DE)

(73) Assignee: WILO SE, Dortmund (DE)

( * ) Notice: Subject to any disclaimer, the term of this patent is extended or adjusted under 35 U.S.C. 154(b) by 0 days.

(21) Appl. No.: 15/114,996

(22) PCT Filed: Mar. 26, 2015

(86) PCT No.: PCT/EP2015/000642
§ 371 (c)(1),
(2) Date: Aug. 12, 2016

(87) PCT Pub. No.: WO2015/144310
PCT Pub. Date: Oct. 1, 2015

(65) Prior Publication Data

US 2017/0037857 A1 Feb. 9, 2017

(30) Foreign Application Priority Data

Mar. 26, 2014 (DE) ..... 10 2014 004 336

(51) Int. Cl.
*F04D 15/00* (2006.01)
*F04D 13/06* (2006.01)
*F04D 1/00* (2006.01)

(52) U.S. Cl.
CPC ..... *F04D 15/0088* (2013.01); *F04D 13/06* (2013.01); *F04D 15/0066* (2013.01); *F04D 1/00* (2013.01)

(58) Field of Classification Search
None
See application file for complete search history.

(56) References Cited

U.S. PATENT DOCUMENTS 410,857 A 9/1889 Schaper
3,922,853 A 12/1975 Kalb
(Continued)

FOREIGN PATENT DOCUMENTS

CN 1127847 A 7/1996
CN 103384768 A 11/2013
WO 2008096731 B 8/2008

*Primary Examiner* — David M. Gray
*Assistant Examiner* — Geoffrey T Evans
(74) *Attorney, Agent, or Firm* — Andrew Wilford

(57) ABSTRACT

The invention relates to a method of determining a first hydraulic variable (Q) of a pump assembly (1) operated at a predefinable rotation speed ($n_0$) from a mechanical or electrical variable ($M_{actual}$, $P_{el}$, $n_{actual}$) by evaluating a correlation between the hydraulic variable (Q) with the mechanical or electrical variable ($M_{actual}$, $P_{el}$, $n_{actual}$). A control parameter ($M_{setpoint}$, $n_{setpoint}$) of the pump assembly (1) is acted on by a periodic excitation signal ($f_{A,n}$ (t), $f_{A,H}$(t)) having a predetermined frequency (f) such that a second hydraulic variable (H, Δp) is modulated. The instantaneous value of the first hydraulic variable (Q) is determined from the mechanical or electrical variable ($M_{actual}$ (t), $P_{el}$ (t), $n_{actual}$ (t)) as a system response (X(t)) to the excitation signal ($f_{A,n}$ (t), $f_{A,H}$(t)), using the correlation. The invention further relates to a pump control system and a pump assembly that are configured for carrying out the method.

15 Claims, 5 Drawing Sheets

(56) References Cited

U.S. PATENT DOCUMENTS

| | | | | |
|---|---|---|---|---|
| 4,108,574 | A | 8/1978 | Bartley | |
| 8,522,543 | B2 | 9/2013 | Krajnik et al. | |
| 2003/0129062 | A1 | 7/2003 | Sabini | |
| 2006/0272385 | A1* | 12/2006 | Lewis | G01F 25/0007 73/1.16 |
| 2007/0212230 | A1 | 9/2007 | Stavale | |
| 2011/0200454 | A1 | 8/2011 | Ahonen | |
| 2015/0211906 | A1 | 7/2015 | Kallesoe | |
| 2015/0354576 | A1* | 12/2015 | Arnoldl | F04D 13/06 417/53 |
| 2016/0054713 | A1* | 2/2016 | Foss | E21B 43/00 700/282 |
| 2016/0265520 | A1* | 9/2016 | Skinner, Jr. | F04B 49/065 |

* cited by examiner

METHOD OF DETERMINING HYDRAULIC OPERATING POINT OF A PUMP

CROSS REFERENCE TO RELATED APPLICATIONS

This application is the US-national stage of PCT application PCT/EP2015/000642 filed 26 Mar. 2015 and claiming the priority of German patent application 102014004336.3 itself filed 26 Mar. 2014.

The present invention relates to a method of determining a first hydraulic variable of a pump assembly operated at a predefinable rotation speed from a mechanical and/or electrical variable by evaluating a correlation between the hydraulic variable on the one hand and of the mechanical or electrical variable on the other hand. The invention further relates to a pump control system, and a pump assembly that is equipped with a pump control system for carrying out the method.

The hydraulic operating point for a pump assembly is usually defined by the volumetric flow and the delivery head, i.e. the differential pressure applied by the pump. The hydraulic operating point is depicted in the so-called HQ diagram where the delivery head or the differential pressure is plotted as a function of volumetric flow. There are numerous control processes operating with and without feedback for pump assemblies that influence these hydraulic variables, and in particular that control along predeterminable characteristic curves. For example, characteristic curve controls are common in which a specified delivery head is held constant for each volumetric flow, so-called Δp-c controls. Another known control is carried out along characteristic curves that define a linear relationship between the delivery head and the volumetric flow, so-called Δp-v controls.

In this regard, for pump control it is necessary to know the volumetric flow and/or the delivery head, i.e. the differential pressure. In the simplest case, sensors may be used, for example a flow sensor for determining the volumetric flow or a differential pressure sensor for determining the differential pressure, from which the delivery head may then be computed. However, these types of sensors make the manufacture of the pump assembly more expensive. Therefore, there is a concern for doing without them.

In addition to measurement, a hydraulic variable may also be calculated from one or more variables that are known for the pump assembly or its control or regulation system, in particular using physical relationships, according to natural laws, involving the sought hydraulic variable. These relationships may be stored in mathematical form in the control or regulation systems of the pump assembly. The computation may be made based, for example, on the electrical power consumption (motor power or supply input power) that is a product of the current and the voltage. This is a variable that is known for the pump assembly, since the current and the voltage are predetermined by the rotation speed control or regulation system, in particular by a frequency converter, depending on the required set-point rotation speed of the pump assembly. In addition, it is particularly easy to measure the current and the voltage using electrical means.

The power characteristic map may be measured by the manufacturer of the pump assembly. That is, the power consumption is determined for selected rotation speeds for a plurality of volumetric flows. These values may, for example, be associated with one another in a table and stored in the control or regulation system of the pump assembly. As an alternative to the table, based on the values that are determined or measured by the manufacturer, a mathematical function (a polynomial, for example) may be determined that describes the relationship between the volumetric flow and the power at a given rotation speed. This function may then be stored in the control or regulation system as an alternative or in addition to the table.

Such a function may, for example, be formed separately for each rotation speed and used, so that the entire power characteristic map is described by a set of functions. Alternatively, a single function may be used that links the three variables power, rotation speed, and volumetric flow. Using a function instead of a table has the advantage that not much memory is required, since it is not necessary to store a large amount of measurement data. However, it is disadvantageous that evaluating the function requires computing power. Using a function in addition to the table has the advantage that a plausibility check, and optionally averaging of the value determined from the table and the function, may be carried out.

If the power consumption and the rotation speed are known, the volumetric flow may be determined from the table or the corresponding function. Based on this value, in turn the delivery head may be computed via the pump characteristic curve, so that the operating point of the pump assembly is obtained.

FIG. 1 shows the relationship between the consumed electrical power and the volumetric flow Q for a pump assembly. The figure illustrates four power characteristic curves for different rotation speeds, the bottom curve being associated with the lowest rotation speed used and the top power characteristic curve being associated with the highest rotation speed used. The power characteristic curves illustrate that in the upper volumetric flow range, there is ambiguity in the characteristic curve progression due to the fact that the characteristic curve continuously rises up to a maximum with increasing volumetric flow, but falls once again as the volumetric flow continues to increase. Thus, for example, at the highest rotation speed, the same power consumption of approximately 250 W is present at Q1=12 $m^3/h$ and also at Q2=16 $m^3/h$. For this reason, a conclusion concerning the volumetric flow based on the determined power cannot be easily drawn by evaluating the table or the function. The method of power association is thus usable only in a limited region of the operating range.

The problem of the ambiguity of the power characteristic curve may be bypassed by taking into account only the left portion of the power characteristic curve, i.e. the volumetric flow that is less than the volumetric flow that is present at the maximum of the power characteristic curve. This means that the hydraulics of the pump assembly in this case are designed such that in the planned operating range the power always increases continuously, and the maximum volumetric flow is present at the location where the power also has its maximum.

Conversely, this means that the hydraulic efficiency has its maximum (best efficiency point (BEP)) at the right edge of the operating range, and therefore the partial load efficiency is low at low volumetric flows. For a high overall efficiency in typical pump applications, however, a high partial load efficiency is much more important than a high full load efficiency, since the pump assembly typically is seldom operated at full load. This is taken into consideration in computing the energy efficiency index (EEI), an important parameter of the efficiency of a pump assembly. For an optimal energy efficiency index (EEI), it would be advantageous for the BEP to lie in the range of average volumetric flow, since this is where the operating point of a pump assembly is very often located. However, in this range it is no longer possible to directly determine the volumetric flow from the power.

The object of the present invention, therefore, is to provide a method of determining a hydraulic variable of a pump assembly that manages without a sensor for this hydraulic variable, and does not limit the control or regulation of the pump assembly.

This object is achieved by a method of determining a first hydraulic variable of a pump assembly operated at a predefinable rotation speed from a mechanical and/or electrical variable by evaluating a correlation between the hydraulic variable on the one hand and of the mechanical or electrical variable on the other hand, is proposed, wherein a control parameter of the pump assembly is acted on by a periodic excitation signal having a predetermined frequency such that a second hydraulic variable is modulated, and the instantaneous value of the first hydraulic variable is determined from the mechanical or electrical variable as a system response to the excitation signal using the correlation.

This approach resolves ambiguities in the correlation of the variables, and allows a pump assembly, using the information available to it, i.e. relating to at least one electrical and/or mechanical variable such as the current, the voltage, the electrical power, the torque, the rotation speed, or the mechanical power, and without using a pressure sensor or volumetric flow sensor, to draw conclusions concerning the hydraulic operating point that is defined, for example, by the first and second hydraulic variables, preferably by the volumetric flow and the delivery head.

The pump assembly may be a centrifugal pump operated by an electric motor, for example a heating pump in a heating system, or a coolant pump in a cooling system.

It is noted that according to the invention, "modulate" is understood to mean change, without the type, magnitude, or speed of the excitation signal being limited in any way. In addition, references below to control of the pump assembly are also to be understood as control with or without feedback of a certain variable.

According to a first embodiment, the instantaneous value of the first hydraulic variable may be determined from the amplitude and/or the phase position of the alternating component of the mechanical or electrical variable, using the correlation. This means that the alternating component of the mechanical or electrical variable is initially determined, and its amplitude or phase position is ascertained. The correlation is subsequently used in order to determine the value of the hydraulic variable from the ascertained amplitude or phase position. Instead of the absolute values, relative values that relate to the excitation signal are preferably used for the amplitude and phase position. In the case of the phase position, this would mean that a determination is made of how many degrees the phase of the system response is shifted relative to the excitation signal. In the case of the amplitude, this means that the ratio of the amplitude of the alternating component of the system response to the amplitude of the excitation signal is determined. The evaluation of the system response based on the correlation may thus take place using absolute values as well as relative values.

In all embodiments of the invention, the correlation may be given by a table or at least one mathematical function. In the case of the first embodiment, this table or the at least one function would associate an amplitude value or phase value of the alternating component with each value or a number of values of the first hydraulic variable for a given rotation speed or a plurality of rotation speeds. This allows the value of the first hydraulic variable at that moment to be determined in a particularly simple manner. This association is to be carried out at the factory by the manufacturer of the pump assembly, by operating the pump assembly at various rotation speeds while the control parameter is acted on by the excitation signal, and measuring the first hydraulic variable and measuring the amplitude and phase position of the alternating component, or computing same based on known relationships. These determined values may then be associated with one another in a table and stored in a control system of the pump assembly.

In the case of the table, the correlation may then be used such that a search is made for the determined amplitude value or phase value in the particular row or column containing the rotation speed corresponding to the instantaneous rotation speed. If this amplitude value or phase value or a similar value is found, the value of the first hydraulic variable associated with the amplitude value or phase value via the corresponding column or row may be determined.

If a function is used instead of the table, the function, solved for the first hydraulic variable, may be employed to compute the value of the first hydraulic variable from the determined amplitude value or phase value. If the correlation is specified by multiple functions, each of which is valid for a given rotation speed, initially the function must be determined that is valid for the instantaneous rotation speed. It is then necessary only to enter the amplitude value or phase value into this function. However, if the correlation is specified by a single function, the determined amplitude value or phase value and the instantaneous rotation speed must be entered into the function in order for the function to provide the value of the first hydraulic variable.

According to a second embodiment, a product of the system response and a periodic function having the same frequency or a multiple of the frequency of the excitation signal may be formed. The integral of this product is subsequently computed over a predetermined, in particular finite, integration period, and the value of the first hydraulic variable is determined from the value of the integral, using the correlation. The value of the hydraulic variable (Q, H) is then determined from the value of the integral, using the correlation.

The alternating component of the mechanical or electrical variable, for example the actual torque, the actual rotation speed, or the electrical power consumption of the pump assembly, may also be used as an alternative to the periodic function. In this case, a product of the system response and this alternating component is formed and integrated. Once again, the value of the hydraulic variable (Q, H) is then determined from the value of the integral, using the correlation.

For this purpose, the instantaneous torque (actual torque), the instantaneous rotation speed (actual rotation speed), or the instantaneous electrical power consumption may be measured or computed from other variables. It may be necessary to initially preprocess, for example filter, measured values before they are suitable for multiplication by the system response. This may be carried out by high-pass or band-pass filtering. When there is sufficiently high excitation of the system, the alternating component contains a dominant fundamental component that approximately corresponds in phase and frequency to the excitation signal. The result of the integration, except for a scaling factor, then corresponds with sufficient accuracy to the result that would be obtained with a purely mathematical periodic function, for example a sine or cosine function. In particular, the result of this computation may be linked in a customary manner to the first hydraulic variable to be determined, so that the latter may be unambiguously determined.

In the second embodiment, the correlation of the hydraulic variable with the mechanical or electrical variable may also be given in the form of a table or a mathematical function.

For example, in such a table a value of the integral may be associated in each case with a number of values of the first hydraulic variable for a given rotation speed. This association is to be carried out at the factory by the manufacturer of the pump assembly, by operating the pump assembly at various rotation speeds, and measuring the first hydraulic variable and computing the integral as described above or based on other known relationships. These determined values may then be associated with one another in a table and stored in a control system of the pump assembly.

As an alternative to the table, a value of the integral may be associated with each value of the hydraulic variable for a given rotation speed, using the mathematical function. This association as well assumes at the outset that the manufacturer has initially measured the pump assembly, by operating the pump assembly at various rotation speeds, and measuring the first hydraulic variable and computing the integral as described above or based on other known relationships. However, these determined integral values are not then stored in a table. Instead, a function, for example a polynomial I(Q), is sought that describes a curve on which the measured values of the hydraulic variable lie. Either a separate mathematical function (polynomial) may be established in each case for a number of various given rotation speeds, or a general mathematical function (polynomial) may be determined that describes the overall characteristic map of the pump assembly, i.e. a function (polynomial) I(Q,n) that describes the dependency of the integral value on the first hydraulic variable (Q) and on the rotation speed (n). This also applies for the first embodiment.

It is advantageous when the periodic function by which the system response is multiplied is a sine function. It is then possible to directly determine from the table or the mathematical function a value of the first hydraulic variable that is associated with the computed value of the integral or that is associated by the mathematical function, since in a sine function, the integration results in a value that is unambiguous when plotted as a function of the first hydraulic variable. This is illustrated in FIG. 2.

The value of the first hydraulic that is associated with the computed value of the integral may thus be determined in reverse from the table that associates an integral value with each value of the first hydraulic variable. Thus, with regard to the table, the second embodiment differs from the first embodiment solely in that the table contains the integral values instead of the amplitude values or phase values.

If a direct association cannot be made because the integral value lies between two table values, a value of the first hydraulic variable to be associated with the computed integral value may be found by interpolating the integral values associated with these two table values. This is also possible in the first embodiment.

In addition, in the case that a mathematical function is used, the value of the hydraulic variable may then be computed based on this mathematical function by using the computed integral value. If multiple mathematical functions are used, each of which is valid only for a specific rotation speed, the magnitude of the instantaneous rotation speed must of course be determined beforehand in order to then determine which of the mathematical functions to use for computing the first hydraulic variable. The rotation speed, at least in the form of the set-point rotation speed, for example, is known by the pump control system.

According to another embodiment, in the table or the mathematical function, instead of the integral values, values of the mechanical and/or electrical variable are linked to values of the first hydraulic variable, as is known per se in the prior art. This means that the correlation here is specified by a table or at least one mathematical function that, for a given rotation speed, associates a value of the mechanical or electrical variable with each value of the first hydraulic variable. As already explained above, in this case there is ambiguity in the correlation. The value of the mechanical or electrical variable is preferably an average value, or in other words, a value that is present in the absence of a periodic excitation.

The ambiguity may be resolved by using a cosine function as the function that is multiplied by the system response, and using the computed value of the integral for distinguishing which portion of the table or which value range of the mathematical function is valid for determining the value of the first hydraulic variable for the instantaneous operating point. This may be clarified with reference to FIG. 3 by way of example. The integral over the product of the system response and the cosine function (in FIG. 3, the power is used as the system response as an example) has a zero crossing at the location where the mechanical or electrical variable as a function of the hydraulic variable has its maximum. In this regard, the value of the computed integral may then be used for determining the value of the first hydraulic variable, the integral value being compared to a threshold value. For a threshold value of zero, this results in the case illustrated in FIG. 3, in which the algebraic sign may be used to determine which portion of the table or which value range of the mathematical function is valid for determining the value of the first hydraulic variable for the instantaneous operating point.

If the algebraic sign is negative, only those values of the first hydraulic variable are taken into account that are below the value of the first hydraulic variable for which the mechanical or electrical variable has its maximum. Otherwise, i.e. if the algebraic sign is positive, only those values of the first hydraulic variable are taken into account that are above the value of the hydraulic variable for which the mechanical or electrical variable has its maximum. Some other threshold value that is different from zero may optionally be used for resolving the ambiguity.

The control parameter that is acted on by the excitation signal is preferably a set-point rotation speed or a set-point torque of the pump assembly, i.e. a mechanical variable that a regulation system of the pump assembly attempts to hold at a certain value. Regulation systems for rotation speed or torque are known per se for pump assemblies. The periodic excitation of the set-point rotation speed or of the set-point torque is a simple measure for achieving a modulation of the second hydraulic variable.

For example, the volumetric flow Q of the pump assembly may be used as the first hydraulic variable. The second hydraulic variable may then suitably be the delivery head H or the differential pressure $\Delta p$. The latter can be modulated very easily by modulating the rotation speed or the torque of the pump assembly.

The mechanical variable is preferably the torque delivered by the pump assembly or the actual rotation speed of the pump assembly. The electrical variable may be, for example, the electrical power $P_{el}$ consumed by the pump assembly or the current. The change in at least one of these variables due to the modulation of the second hydraulic variable is then regarded as the system response.

Thus, any given pairs of the excited control parameter and the system response to be analyzed may be used. For example, the set-point rotation speed may be modulated, and the resulting actual rotation speed may be evaluated. Instead of the actual rotation speed, the delivered torque or the electrical power consumption may be used for the evaluation. In addition, instead of exciting the set-point rotation speed, the set-point torque may be excited, and the resulting actual rotation speed, the delivered torque, or the electrical power consumption may be evaluated.

The excitation signal is ideally a periodic signal, in particular a sinusoidal signal or a signal containing a sine function. The latter may also be a triangular signal or a sawtooth signal, for example.

The frequency of the excitation signal is advantageously between 0.01 Hz and 100 Hz. However, a disadvantage of an excessively low frequency is the duration of a full period, which for an excitation frequency of 0.01 Hz, for example, is 1 minute and 40 seconds. The longer the period duration, the greater the likelihood that the hydraulic resistance of the system, and therefore also the operating point of the pump assembly, will change, thus skewing the determination of the instantaneous operating point. For this reason, the excitation frequency should not be too small. Likewise, upper limits for the frequency are set due to the inertia of the rotor, of the impeller, and of the liquid.

The amplitude of the excitation signal is preferably less than 25% of the rotation speed threshold value, and in particular may be between 0.1% and 25% of the rotation speed threshold value. Thus, for a set-point rotation speed of 2000 rpm, for example, a rotation speed fluctuation of ±2 rpm to ±500 rpm may be suitable.

The amplitude of the excitation signal may be computed from a desired delivery head fluctuation, using a mathematical equation that describes the relationship between the rotation speed and the delivery head at the pump assembly. This equation may be determined, for example, from the following formula that describes the stationary relationship between the delivery head H, the rotation speed n, and the volumetric flow Q:

$$H_p(Q,n)=an^2-bQn-cQ^3 \qquad \text{Eq. 1}$$

where a, b, and c are parameters of the pump characteristic curve. Setting $H_p=H_0+f_{A,H}$ where $f_{A,H}$ describes the desired fluctuation of the delivery head H by the stationary delivery head $H_0$, results in:

$$H_0+f_{A,H}=an^2-bQn-cQ^2 \qquad \text{Eq. 7}$$

$$n^2-\frac{bQ}{a}n-\frac{cQ^2}{a}-\frac{H_0}{a}-\frac{f_{A,H}}{a}=0$$

$$n^2-\frac{bQ}{a}n-\frac{cQ^2}{a}-\frac{(an_0^2-bQn_0-cQ^2)}{a}-\frac{f_{A,H}}{a}=0$$

$$n^2-\frac{bQ}{a}n-\frac{(an_0^2-bQn_0)}{a}-\frac{f_{A,H}}{a}=0$$

$$n=\frac{bQ}{2a}+\sqrt{\left(\frac{bQ}{2a}\right)^2+n_0^2-\frac{bQn_0}{a}+\frac{f_{A,H}}{a}}$$

Thus, for Q=0 this results in:

$$n=\sqrt{n_0^2+\frac{f_{A,H}}{a}} \qquad \text{Eq. 8}$$

If a certain change $f_{A,H}$ in the delivery head H is to be achieved, the change in the rotation speed excitation signal may thus be determined using Equation 7 or Equation 8.

In the second and further embodiments, the integral of the product of the system response and the periodic function is computed over a time T. This integration period T may be one period, or a multiple of the period of the excitation signal. It is advantageous when the modulation takes place uninterrupted, i.e. over the entire operating time of the pump assembly. In this way, changes in the operating point may be immediately recognized. This would not be possible if the method according to the invention were applied only in time intervals for a limited duration in each case.

The detection of the mechanical or electrical variable as a system response to the modulation may take place either at discrete points in time or continuously. The system response is then present as a sequence of values, so that the multiplication by the function and the integration of the product thus obtained may take place at any time.

According to another advantageous refinement of the method according to the invention, during the computation of the integral, at least one further integral may be computed from a product of the system response and the function over the same integration period, the start of this integration period of the further integral being offset in time with respect to the start of the integration period of the first integral. The computed values of the integrals may then be combined into an averaged value. This has the effect of smoothing the determined system response.

The values to be integrated may be "cut," in a manner of speaking, from the series of detected system response values by using a finite integration period. In signal processing, this is known as "windowing"; i.e. the values are cut by multiplying by a window function $F_F(t)$ that has the form $F_F(t)=f(t)$ for $t_0<t<t_1$, and otherwise $F_F(t)=0$. In the simplest case, for f(t)=1 (rectangular window), the "cut" values are multiplied, unchanged, by the function and subsequently integrated; i.e. no weighting of the values takes place. However, it is advantageous to filter the values by applying a weighting of the values to be integrated. Such weighting may take place, for example, by multiplying the system response by a window function that weights the values situated in the middle of the window more heavily than those situated at the edge of the window. A number of window functions that are known and customary in practice are available for such weighting, for example, the Hamming window, Gauss window, etc.

If the operating point of the hydraulic system is not constant, the value of the computed integral is skewed by the change in the operating point. However, this skewing may be at least partially corrected by assuming a linear shift of the operating point and correcting it during the computation of the integral. In the simplest case, for this purpose the values of the system response at the start and at the end of the integration period are determined, in particular measured, and a linear change in the system response per unit time is determined from these two values. This linear change is then subtracted from all values of the system response determined in the integration period, and only then is the integral formed. In this case, however, the determined values must be initially stored. The integral may then be computed as follows:

where $$I(t_0+T)=\int_{t_0}^{t_0+T}\left(X(t)-\left(\frac{X(t_0+T)-X(t_0)}{T}\right)\cdot(t-t_0)\right)\cdot S(t)dt$$

$$\text{with } T=\frac{k_I 2\pi}{\omega}$$

where $I(t_0+T)$ is the integral to be computed from time $t_0$ over the integration period T, X(t) is the system response, S(t) is the periodic function, $k_I$ is a positive integer, and ω is the frequency of the excitation signal $f_{A,n}$ (t), $f_{A,H}$ (t).

It is also possible to make this correction only after the integral has been computed in order to be able to dispense with intermediate storage of the measured values. In this regard, reference is made here to the relevant technical literature concerning integral transformations according to the prior art.

According to the invention, also proposed is a pump electronics system for controlling and/or regulating the set-point rotation speed of a pump assembly, and that is configured for carrying out the method described above. In addition, a pump assembly having such a pump electronics system is proposed. The pump assembly may be a heating pump, a coolant pump, or a drinking water pump, for example. It is generally necessary to determine the volumetric flow to be able to carry out energy-efficient pump regulation. By use of the method according to the invention, volumetric flow sensors may be dispensed with. This simplifies the structure of the pump housing and reduces the cost of manufacturing the pump assembly. The pump assembly is preferably a centrifugal pump operated by an electric motor, ideally having a glandless design. Such a pump assembly may be used in a heating, cooling, or drinking water system.

The invention is explained in greater detail below with reference to examples and the accompanying figures that show the following:

The method described below for determining the hydraulic operating point uses, in addition to the static hydraulic characteristic curve, information concerning the dynamic behavior of the system that is analyzed by targeted excitation.

Figure 6:
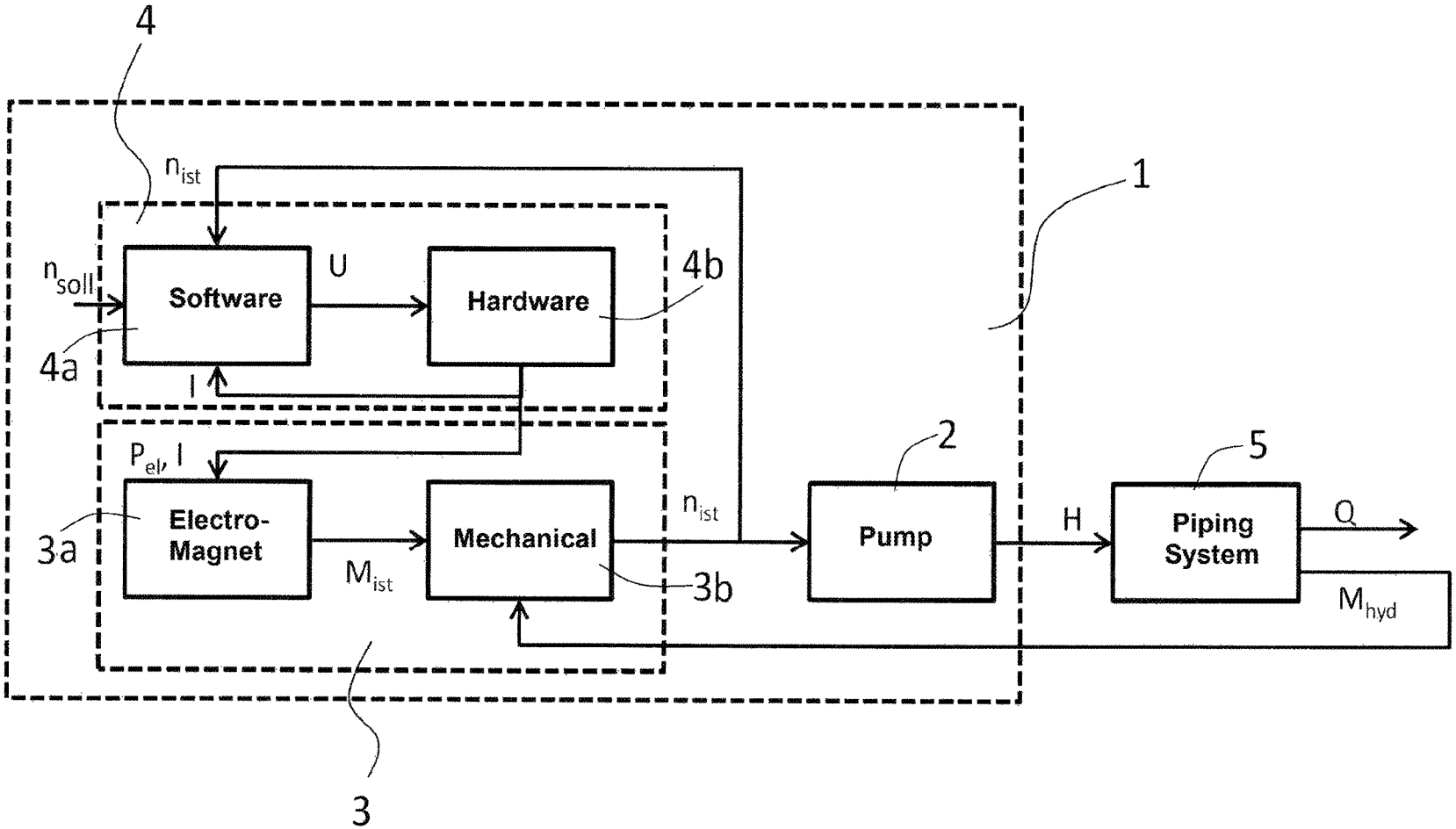
FIG. 6 shows a system for using the method according to the invention.

FIG. 6 shows, as a block diagram, a model of the system in which one embodiment of the method according to the invention may be used. The FIG. illustrates a variable-speed centrifugal pump assembly 1 that is connected to a piping system 5 or is integrated into same. The system may be a heating system, for example, in which case the pump assembly 1 is a heating pump. The piping system 5 is then formed by lines that lead to the heating elements or heating circuits and lead back to a central heat source. For example, water may circulate in the pipes 5 as the liquid that is driven by the pump assembly 1. The pump assembly 1 is made up of a pump unit 2 that forms the hydraulic portion of the assembly 1, an electric motor drive unit 3 that forms the electromechanical portion of the assembly 1, and a control or regulation system 4. The drive unit 3 is made up of an electromagnetic portion 3*a* and a mechanical portion 3*b*. The regulation system 4 is made up of software 4*a*, and hardware 4*b* that includes the control and/or regulation electronics system as well as the power electronics, for example a frequency converter.

A set-point rotation speed $n_0$ is specified for the regulation electronics system 4. Based on the instantaneous current consumption I and the instantaneous rotation speed $n_{actual}$ of the drive unit 3, the regulation electronics system computes a voltage U that is specified for the power electronics system 4*b*, so that the latter provides the drive unit 3 with appropriate electrical power $P_{el}$. The electromagnetic portion 3*a* of the drive unit 3 including the stator, rotor, and their electromagnetic coupling, generates a mechanical torque $M_{actual}$ from the current. The mechanical torque accelerates the rotor and results in a corresponding rotation speed n of the drive unit 3 that is included in the mechanical portion 3*b* of the model of the drive unit 3. The pump impeller of the hydraulic portion 2 of the pump assembly 1 resting on the rotor shaft is driven at the rotation speed $n_{actual}$. The pump assembly 1 thereby produces a delivery head H, which generates a fairly large volumetric flow Q in the piping system 5, depending on the pipe resistance. Based on the hydraulic power and the associated losses, a hydraulic torque $M_{hyd}$ may be defined that as a braking torque counteracts the motor torque $M_{actual}$.

Figure 4:
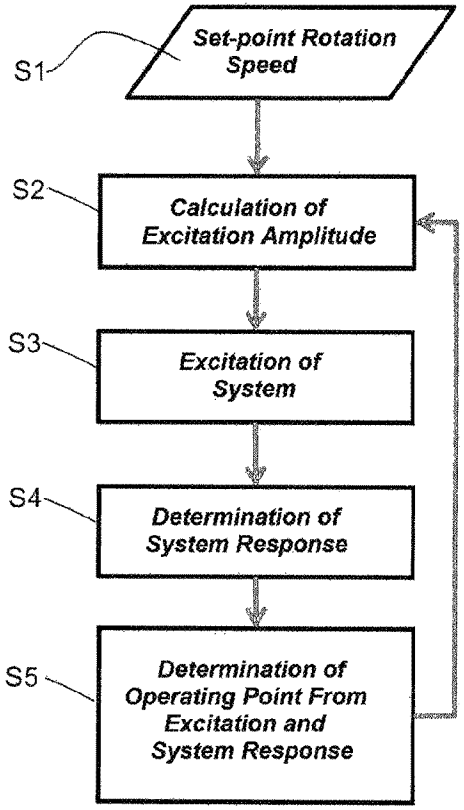
FIG. 4 shows a flow chart of the method.

The basic sequence of the method according to the invention is illustrated in FIG. 4. The method is carried out during proper operation of the pump assembly, i.e. when the pump assembly 1 is connected to a piping system 5 and operated at the set-point rotation speed $n_0$. Starting from the specification of the set-point rotation speed $n_0$ in step S1 that may be specified manually or that may result from an adjustable characteristic curve control (Δp-c, Δp-v, for example) or a dynamic adjustment of the operating point, the method according to the invention comprises the following three steps that are to be carried out in succession, and that may be continuously repeated:

excitation of the system, step S3;

ascertainment of the system response, step S4;

determination of the sought hydraulic variable or the operating point, based on the excitation and the system response, step S5.

Figure 5:
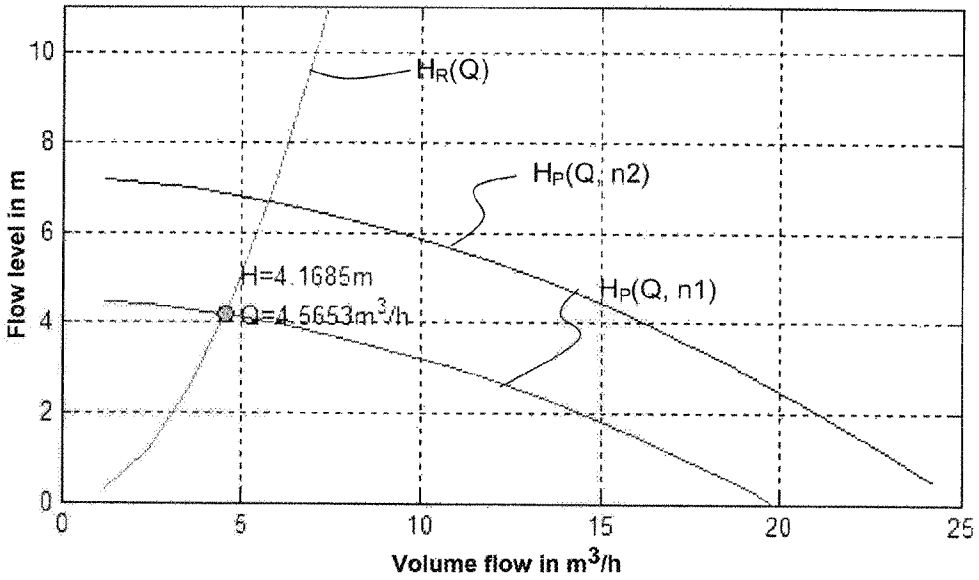
FIG. 5 shows an operating point of a pump assembly in the HQ diagram.

The hydraulic variable to be determined is the volumetric flow Q of the pump assembly, by way of example. The delivery head H may be determined based on the generally known physical-mathematical relationship between the volumetric flow Q and the delivery head H at the pump assembly 1, thus establishing the hydraulic operating point [Q, H] of the pump assembly. The physical-mathematical relationship is defined by the pump characteristic curve $H_p(Q,n)$ $$H_p(Q,n)=an^2-bQn-cQ^2 \quad \text{Eq. 1}$$

and the pipe network parabola $H_R(Q)$ $$H_R(Q)=dQ^2 \quad \text{Eq. 2}$$

where the stationary operating point lies at the point of intersection of the pump characteristic curve and the pipe network parabola (see FIG. 5). At that location, the following applies:

$$H_R(Q)=H_p(Q,n) \quad \text{Eq. 3}$$

The pump characteristic curve $H_p(Q)$ is known by the manufacturer based on the measurement of the pump assembly. The parameters a, b, c are constant parameters of the pump characteristic curve. The pipe network parabola is a function of the state of the piping system that is connected to the pump assembly, and whose hydraulic resistance is reflected by the slope d of the pipe network parabola. The hydraulic resistance is largely determined by the opening degree of the valves present in the piping system, so that the slope d results from the valve position.

The excitation of the system takes place by modulating the stationary set-point rotation speed $n_0$ with an excitation signal $f_{A,n}$ (t), so that the new set-point rotation speed $n_{setpoint}$ to be set by the pump electronics system 4 results from the sum of the set-point rotation speed $n_0$, predefined beforehand, and the excitation signal $f_{A,n}(t)$:

$$n_{setpoint}=n_0+f_{A,n}(t) \quad \text{Eq. 5}$$

This may result in a sinusoidal variation of the rotation speed, for example, although other modulations are also conceivable. The excitation signal $f_{A,n}$ (t) is then, for example, a sinusoidal signal of the form $$f_{A,n}(t)=n_1 \sin \omega t \quad \text{Eq. 6}$$

with amplitude $n_1$ and frequency $\omega=2\pi f$.

The amplitude is between 0.1% and 25% of the set-point rotation speed $n_0$, and may be set and fixed by the manufacturer.

However, it is advantageous for the delivery head H, not the rotation speed n, to be sinusoidally excited so that the following is valid:

$$H(t)=H_0+f_{A,H}(t)=H_0+H_1\cdot\sin(\omega t) \quad \text{Eq. 7}$$

with amplitude $H_1$ and frequency $\omega=2\pi f$.

Thus, if a certain delivery head fluctuation $f_{A,H}$ (t) of ±15 cm, for example, is to be achieved, not a certain rotation speed fluctuation $f_{A,n}$ (t), but the delivery head fluctuation is a function of the instantaneous operating point of the pump assembly 2, i.e. a function of the instantaneous rotation speed $n=n_{actual}$ and the instantaneously required volumetric flow Q, prior to the excitation of the system in step S3 the rotation speed fluctuation $f_{A,n}$ (t) required for achieving the desired delivery head fluctuation $f_{A,H}$ (t) may be computed in step S2:

$$n = n_0 + f_{A,n} = \frac{bQ}{2a} + \sqrt{\left(\frac{bQ}{2a}\right)^2 + n_0^2 - \frac{bQn_0}{a} + \frac{f_{A,H}}{a}} \quad \text{Eq. 8}$$

Since the volumetric flow Q in general is not to be determined until the method according to the invention is applied, and therefore is unknown, Equation 8 may be simplified by the approximation Q=0, resulting in $$n = n_0 + f_{A,n} = \sqrt{n_0^2 + \frac{f_{A,H}}{a}} \quad \text{Eq. 9}$$

Figure 7:
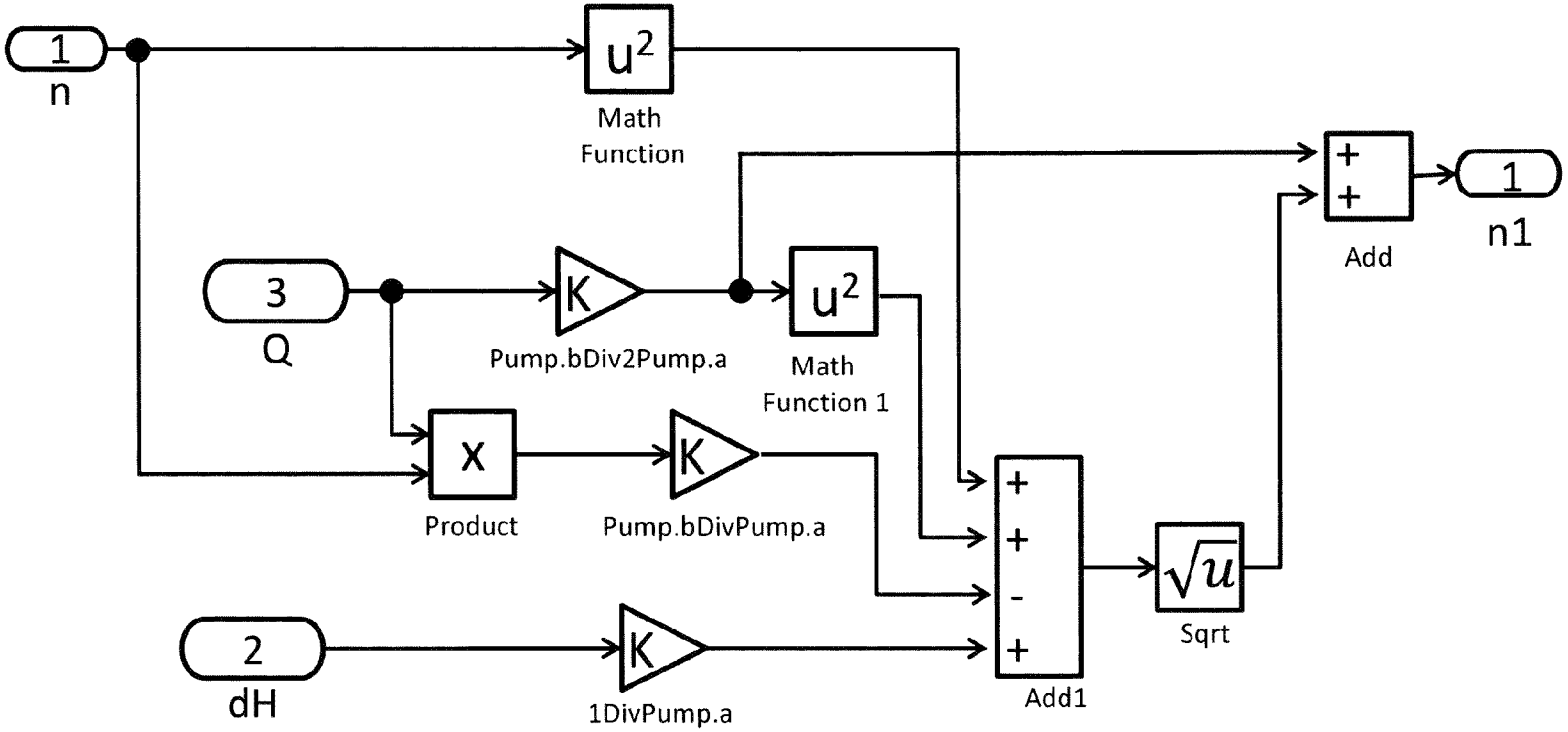
FIG. 7 is a block diagram of an analog circuit for computing the modulated set-point rotation speed.

The computation according to Equation 8 or 9 may be carried out numerically in a microprocessor in the pump electronics system 4, or by an analog circuit, as illustrated in a block diagram in FIG. 7 by way of example.

When the method according to the invention is continuously repeated, step S2 follows step S5. The volumetric flow Q determined in step S5 in the operating point determination may then be used directly in equation 8.

However, it is also possible to determine the excitation signal without taking the volumetric flow Q into account, in which case Equation 9 applies.

The magnitude of the excitation frequency f should be such that the delivery head H follows the excitation function $f_{A,H}$ as closely as possible, despite the inertia of the rotor. In the illustrated embodiment, a frequency f of 1 Hz is used.

Figure 1:
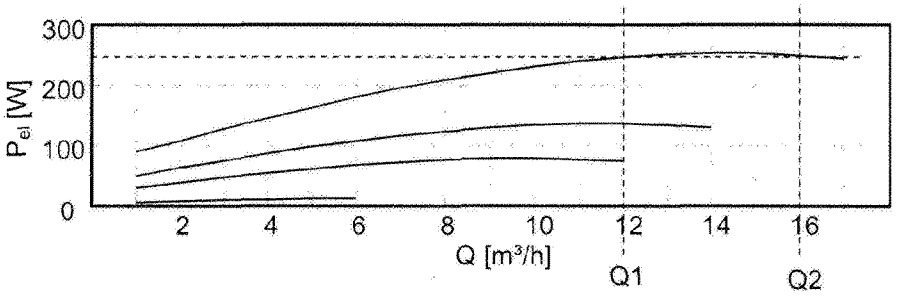
FIG. 1 is a diagram with power characteristic curves of a pump assembly at various rotation speeds.

The system response to the excitation is manifested in various physical variables of the pump assembly, and also purely mathematically in variables that are present in the models, i.e. the electrical model 4*b*, the electromagnetic model 3*a*, the mechanical model 3*b*, and the hydraulic model 2. However, it is sufficient to evaluate a single mechanical or electrical variable of the pump assembly. In the illustrated embodiment, the consumed electrical power $P_{el}$ (FIGS. 1, 2, 3), or alternatively, the mechanical torque $M_{mot}$, is used as the system response X(t) to the modulation. The consumed electrical power $P_{el}$ is measured, or is determined from the measured current and the measured or computed voltage. The torque $M_{actual}$ may be measured, or computed from the torque-forming current that is available in the mathematical electromagnetic and mechanical models in the regulation electronics system 4 for carrying out the regulation or for observing the system.

The power $P_{el}$ and/or the torque $M_{actual}$ may be determined by sampling at discrete points in time or continuously, so that the system response X(t) is present as a discrete or continuous series of measured values or computed values. This is included in step 4 in FIG. 4. For the sake of simplicity, only the case of the continuous series is discussed here.

For computing the operating point in step S5, initially the volumetric flow Q is determined. This is carried out by first multiplying the system response X(t) by a periodic function S(t), i.e. by forming the product of the system response X(t) and this periodic function S(t). In the present example, the periodic function S(t) is a sine function $S_1$ (t)=$S_3$ (t) or cosine function $S_2$ (t)=$S_{cos}$ (t) in the form of $$S_{sin}(t)=g_1\cdot\sin(k\cdot\omega t) \quad \text{Eq. 10}$$

or $$S_{cos}(t)=g_2\cdot\cos(k\cdot\omega t) \quad \text{Eq. 11}$$

where $g_1$, $g_2$ are scaling factors and k is a positive integer. The parameters $g_1$, $g_2$, and k may be selected independently of one another. In the example, $g_1=g_2=k=1$. This illustrates that in the simplest case, the functions $S_{sin}$(t), $S_{cos}$(t) may have the same periodic base structure as the excitation signal $f_{A,n}$ (t), $f_{A,H}$ (t), and in particular may have the same frequency ω or f, in order to achieve the result according to the invention.

The product of the system response X(t) and the function $S_{sin}$(t), $S_{cos}$(t) is subsequently integrated over a time T that corresponds to the period duration or a multiple $k_1$ of the period duration of the excitation signal. This may take place for the electrical variable X(t)=$P_{el}$(t) as well as for the mechanical variable X(t)=$M_{mot}$(t). The integrals I($t_0$) over the product then result in:

$$I_{sin}(t_0+T) = \int_{t_0}^{t_0+T} X(t)\sin(\omega t)dt \; mit \; T = \frac{k_1 2\pi}{\omega} \quad \text{Eq. 12}$$

where $$I_{cos}(t_0+T) = \int_{t_0}^{t_0+T} X(t)\cos(\omega t)dt \; mit \; T = \frac{k_1 2\pi}{\omega} \quad \text{Eq. 13}$$

where $t_0$ indicates the start of integration. Forming the integrals I($t_0$+T) results in an evaluation of the system response X(t) at the excitation frequency w or a multiple $k_1$ of the excitation frequency w over one or more periods $2\pi/\omega$. At the same time, the evaluation takes place at a point in time when the pump assembly 1 requires a certain volumetric flow Q at a given rotation speed $n_0$ that is determined by the instantaneous state of the piping system, i.e. the pipe network parabola that is valid at that moment. This means that a given volumetric flow value at a given rotation speed is associated with each computed integral value $I(t_0+T)$.

For these reasons, as has also been carried out heretofore according to the prior art, the pump assembly must be measured by the manufacturer on a hydraulic test stand if the relationship is not known. According to the invention, however, it is not, or is not just, the relationship between the sought hydraulic variable Q, the rotation speed n, and the electrical or mechanical variable $P_{el}$, $M_{actual}$ that is measured and stored as a characteristic curve map, on the one hand as the correlation of the hydraulic variable Q with the mechanical or electrical variable $M_{actual}$, $P_{el}$, and on the other hand in the pump electronics system 4 as a table or formula. Instead, the relationship between the actual rotation speed, the volumetric flow Q, and one of the above-mentioned integrals $I(t_0+T)$ is determined. For this purpose, for a number, in particular a plurality, of predetermined set-point rotation speeds $n_0$ for a number, in particular a plurality, of measured volumetric flows Q, in each case the integral $I(t_0+T)$ that results from the product of the system response X(t) and the sine or cosine function $S_{sin}(t)$, $S_{cos}(t)$ due to excitation of the system with the excitation signal $f_{A,n}(t)$, $f_{A,H}(t)$, is computed by the manufacturer on a hydraulic test stand. It is then possible to represent the integral $I(t_0+T)$ as a function of the rotation speed $n_{actual}$ over the volumetric flow Q, i.e. as I(Q,n).

Figure 2:
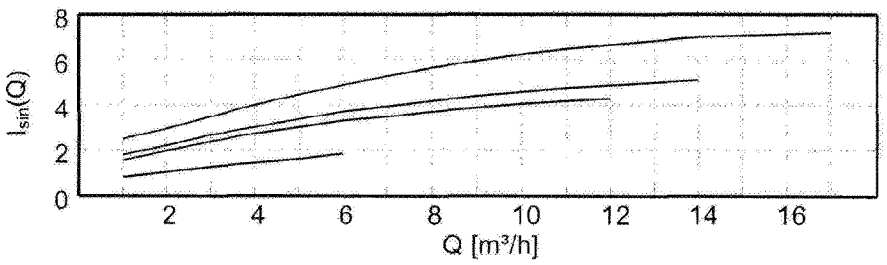
FIG. 2 is a diagram with four curves for different rotation speeds that associate with each volumetric flow a value of the integral of a product of the power and a sine function over an integration period of one period of the excitation signal.

FIG. 2 shows four curves for the integral I(Q) for the rotation speeds $n_0$=1350 rpm, 2415 rpm, 2880 rpm, and 3540 rpm (from bottom to top); in the present case the electrical power $P_{el}$ has been analyzed as the system response X(t) and multiplied by a sine function $S_{sin}(t)$. It is apparent that the simulation curves in FIG. 2, in contrast to the power curves in FIG. 1, describe an unambiguous relationship between the volumetric flow and the integral, since the curves rise monotonically over the entire volumetric flow range. During proper operation of the pump assembly 1, for a computed integral value $I(t_0+T)$ this allows the instantaneously required volumetric flow Q to be determined from the relationship I(Q) ascertained on the test stand. By use of this information, the delivery head H may also be computed, for example using Equation 1.

Consequently, the value of the first hydraulic variable, the volumetric flow Q, is determined from the value of the integral, using the relationship.

For determining the volumetric flow Q from the values $I(t_0+T)$, $n_0$, Q ascertained on the test stand, these values are linked and stored in the pump control system 4. The correlation takes place in the form of a table, which at the rotation speeds $n_0$ used, in each case associates a value of the sought hydraulic variable Q with a plurality of integral values $I(t_0+T)$. During operation of the pump assembly 1, for a computed integral value $I(t_0+T)$ it is then necessary only to extract the volumetric flow value Q associated with this value from the table. If a computed integral value $I(t_0+T)$ is present that is between two integral values $I(t_0+T)$ contained in the table, interpolation between the volumetric flow values Q associated with these two tabular integral values I(Q) may be carried out in a known manner.

As an alternative or in addition to the tabular correlation, a single, or, for all rotation speeds, a global, mathematical function (a polynomial, for example) that describes a characteristic curve, or in the case of the global function, a characteristic curve map, on which all measured values lie may be determined by the manufacturer from the values ascertained on the test stand for each rotation speed $n_0$ used. When multiple functions, each of which is valid for one rotation speed, are used, it is then necessary only to determine the function that is valid at that moment, and to use the computed integral value in order to obtain the corresponding value of the hydraulic variable, i.e. the volumetric flow value. If a global function is used for describing the entire characteristic curve map, the rotation speed and the computed integral value may be inserted directly into this equation in order to obtain the corresponding value of the hydraulic variable.

Figure 3:
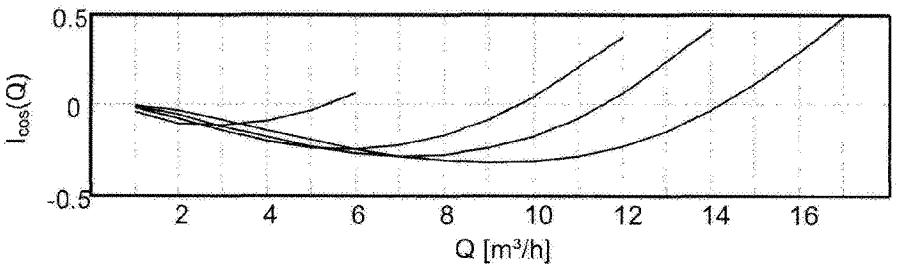
FIG. 3 is a diagram with four curves for different rotation speeds that associate with each volumetric flow a value of the integral of a product of the power and a cosine function over an integration period of one period of the excitation signal.

FIG. 3 shows four simulation curves for the integral I(Q) for the same rotation speeds as in FIG. 2; here as well, the electrical power $P_{el}$ has been analyzed as the system response X(t), but has been multiplied by a cosine function $S_{cos}(t)$. It is shown that the simulation curves in FIG. 3, the same as the power curves in FIG. 1, do not describe an unambiguous relationship between the volumetric flow Q and the integral $I(t_0+T)$, since the curves initially drop, but then subsequently rise, with increasing volumetric flow Q. However, the simulation curves in FIG. 3 allow recognition of a special feature, namely, that the computed integral $I(t_0+T)$ has the value zero at the location where the associated power characteristic curve (see FIG. 1) has its maximum.

In the simulation, the algebraic sign of the cosine signal changes precisely at the peak in the power characteristic curve, so that the algebraic sign of this signal may also be used here for identifying the operating point, i.e. to the right or left of the peak of the power characteristic curve.

During proper operation of the pump assembly 1, for a threshold value of 0, i.e. based on the algebraic sign of the computed integral $I(t_0+T)$, based on a threshold value this knowledge allows a decision to be made as to which of the two volumetric flow values Q1, Q2 associated with a certain power consumption in the ambiguous range of the power characteristic curve (see FIG. 1) is the correct one. Thus, the smaller volumetric flow value Q1 may be used when the integral $I(t_0+T)$ has a negative algebraic sign, and the larger volumetric flow value Q2 may be used when the integral has a positive algebraic sign.

When this variant of the method according to the invention is to be used, it is not necessary for the manufacturer to determine on the hydraulic test stand the volumetric flow and its associated integral value for various rotation speeds. Rather, the same as in the prior art, it is sufficient to measure the power characteristic map and determine the threshold value, and to store these values as a table or as at least one power characteristic curve equation in the pump electronics system 4. The table or at least one function then associates in each case a value of the mechanical or electrical variable with the values of the hydraulic variable at a given rotation speed.

During proper operation of the pump assembly, based on the algebraic sign of the integral $I(t_0+T)$, the system response X(t), and the cosine function $S_{cos}(t)$, it is then possible to decide which portion of the table or which value range of the equation is to be evaluated. Thus, for $I(t_0+T)<0$, the left portion of the power characteristic curve with regard to the maximum value of the power $P_{el}$ is taken into account. Correspondingly, for $I(t_0+T)>0$, the right portion of the power characteristic curve with regard to the maximum value of the power $P_{el}$ is taken into account.

To further improve the method, during the computation of the integral $I(t_0+T)$, at least one further integral $I(t_1+T)$ of the product of the system response X(t) and the function S(t) may be computed over the same integration period T, the start of integration $t_1$ of the further integral being shifted in time with respect to the start of integration $t_0$ of the first integral $I(t_0+T)$ by the offset $t_1-t_0$. The computed values of the integrals $I(t_0+T)$, $I(t_1+T)$ are then averaged to obtain a single value.

The computation of the integrals over a finite integration period means that in each case a series of values is cut from the system response X(t), and these values then represent a "window" of the system response. When the start of integration of the further integral is shifted in time with respect to the first integral, the cut windows in question overlap one another.

Figure 8:
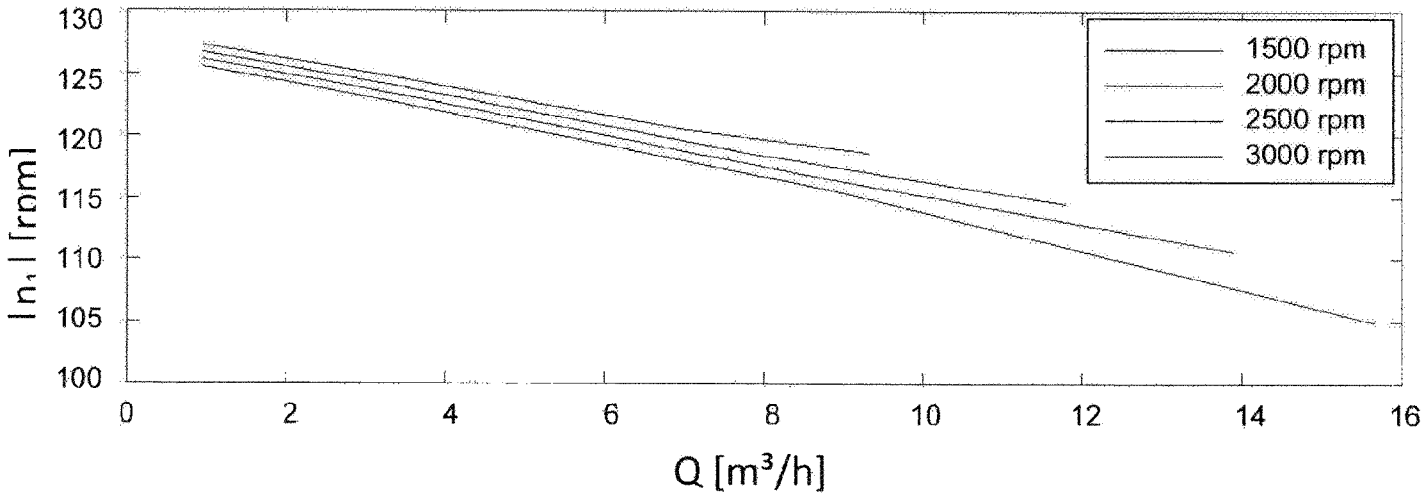
FIG. 8 is a diagram with four curves for different rotation speeds that associate with each volumetric flow an amplitude value of the modulated actual rotation speed.
Figure 9:
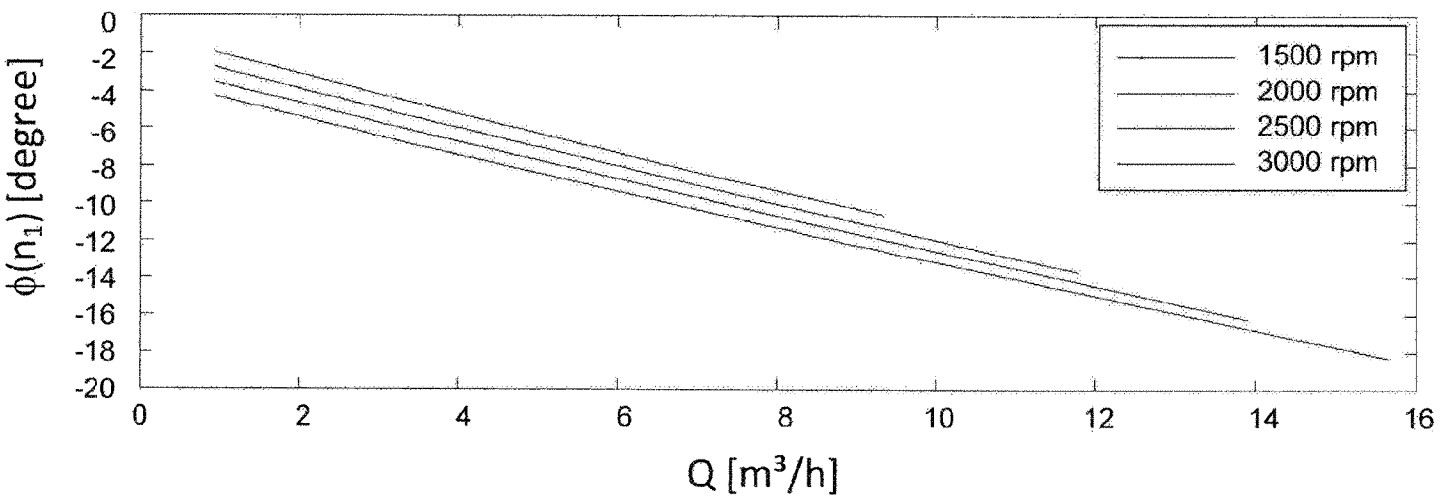
FIG. 9 is a diagram with four curves for different rotation speeds that associate with each volumetric flow a phase value of the modulated actual rotation speed with respect to the excitation signal.

FIGS. 8 and 9 show, similarly to FIGS. 2 and 3, a graphical depiction of the correlation of the volumetric flow Q, as the first hydraulic variable, to the actual rotation speed as the mechanical variable, for four different rotation speeds. In FIG. 8, the amplitude $[n_1]$ of the actual rotation speed is indicated in revolutions per minute, and in FIG. 9 the phase $\varphi(n_1)$ is indicated in degrees. The correlations are each given by four curves that, viewed from top to bottom, are associated with the unexcited rotation speeds $n_0$=1500 rpm, $n_0$=2000 rpm, $n_0$=2500 rpm, and $n_0$=3000 rpm. Thus, the highest curve corresponds to a rotation speed of 1500 rpm, and the lowest curve corresponds to a rotation speed of 3000 rpm.

In the cases in FIGS. 8 and 9, the set-point rotation speed $n_{setpoint}$ has been excited by modulating a periodic signal to a static set-point rotation speed. The actual rotation speed $n_{actual}$, disregarding interferences, is then obtained from the sum of the average rotation speed $n_0$ and the periodic component $n_1(t)$. The phase $\varphi(n_1)$ in FIG. 9 is based on the excitation signal, and represents a phase shift, in a manner of speaking. The values shown in FIGS. 8 and 9 are measured by the manufacturer and stored as a table or mathematical function in the control system of the pump assembly.

It is apparent here that the amplitude $[n_1]$ and the phase $\varphi(n_1)$ are unambiguous for each rotation speed over the volumetric flow. Thus, for a given operating speed that is known by the pump control system, after the amplitude $[n_1]$ or the phase $\varphi(n_1)$ of the excited actual rotation speed is ascertained, the volumetric flow Q that is associated with the ascertained amplitude $[n_1]$ or the phase $\varphi(n_1)$ at the average operating speed $n_0$ that is present is determined. Thus, for example, at an operating speed of 2500 rpm and an amplitude of 120 rpm, a volumetric flow of 6 $m^3/h$ would be present.

The method presented here allows a hydraulic variable, for example the volumetric flow, to be easily determined during operation of the pump assembly, and without using a corresponding sensor.

A second hydraulic variable, for example the delivery head, is modulated, in particular is excited to oscillation that may take place, for example, by modulating the set-point rotation speed or the motor torque as a control parameter of the pump assembly.

By determining the system response, for example the actual rotation speed, the torque delivered by the pump assembly, or the electrical power, and evaluating same by determining the amplitude or phase position of the alternating component of the system response or by multiplying by a function having the same frequency as the excitation, and integrating the resulting product, values are obtained that have a mathematically unambiguous relationship with the sought hydraulic variable. It is then possible to determine the value of the sought hydraulic variable by evaluating this relationship that is to be stored in the pump electronics system of the pump assembly.

The invention claimed is:

1. A pump assembly having a pump electronics system for controlling the set-point rotation speed of a pump assembly, wherein the pump electronics system is configured to determine the volumetric flow of the pump assembly by the steps of:

operating the pump assembly at a predetermined set-point rotation speed or set-point torque;

generating a period excitation signal having a predetermined frequency;

modulating the delivery head or the differential pressure of the pump assembly by applying the periodic excitation signal to the set-point rotation speed or the set-point torque;

determining as a system response to the modulation one of the following:

the electrical power consumed by the pump assembly, or the electrical current consumed by the pump assembly, or, if the periodic excitation signal is applied to the set-point rotation speed, the torque delivered by the pump assembly, or, if the periodic excitation signal is applied to the set-point torque, the rotation speed of the pump assembly; and determining the volumetric flow from the system response by using a correlation in form of a table or at least one mathematical function describing a relationship between the volumetric flow and the system response.

2. The pump assembly according to claim 1, wherein the pump electronics system is further configured to carry out the step of:

determining the amplitude or the phase position of the alternating component of the system response; and determining the volumetric flow from the amplitude of the phase position using the correlation.

3. The pump assembly according to claim 2, wherein the table or the at least one mathematical function for a given rotational speed or a plurality of rotational speeds an amplitude value or phase value of the alternating component with each value or a number of values of the volumetric flow.

4. The pump assembly according to claim 1, wherein the pump electronics is further configured to perform the steps of:

calculating a product of the system response and a periodic function having the same frequency or a multiple of the frequency of the excitation signal, or a product of the system response and the alternating component of the system response, computing the integral of one of these products over a predetermined integration period, and determining the volumetric flow from the value of the integral, using the correlation.

5. The pump assembly according to claim 4, wherein the table or the at least one mathematical function that associates for a given rotational speed or a plurality of rotational speeds a value of the integral with each value or a number of values of the volumetric flow.

6. The pump assembly according to claim 5, wherein the periodic function is a sine function, and a value of the volumetric flow is determined from the table or the mathematical function that is associated with the computed value of the integral in the table, or that is associated by the mathematical function.

7. The pump assembly according to claim 4, wherein the table or the at least one mathematical function associates for a given rotational speed or a plurality of rotational speeds a value of the system response with each value of the volumetric flow, and the periodic function is a cosine function, and for the instantaneous operating point the value or the algebraic sign of the computed value of the integral is used for distinguishing which portion of the table or which value range of the mathematical function is valid for determining the value of the volumetric flow.

8. The pump assembly according to that claim 4, wherein the integration period is one period or a multiple of the period of the excitation signal.

9. The pump assembly according to claim 4, wherein the integration is carried out during the modulation.

10. The pump assembly according to claim 4, wherein during the computation of the integral, at least one further integral is computed from a product of the system response on the one hand and the periodic function, or the alternating component of either the actual torque or the actual rotation speed of the pump assembly on the other hand over the same integration period, wherein the start of integration of the further integral is offset in time with respect to the start of integration of the first integral, and the computed values of the integrals are averaged to form one value.

11. The pump assembly according to claim 4, wherein the pump electronics is further configured to execute the steps of:

determining the values of the system response at the start and at the end of the integration period, determining from these values a change in the system response per unit time subtracting this change from all values of the system response determined during the integration period, and thereafter computing the integral.

12. The pump assembly according to claim 1, wherein the excitation signal, is a sinusoidal signal or a signal containing a sine function.

13. The pump assembly according to claim 1, wherein the frequency of the excitation signal is between 0.01 Hz and 100 Hz.

14. The pump assembly according to claim 1, wherein the amplitude of the excitation signal is less than 25% of the set-point rotation speed of a rotation speed control of the pump assembly, and is between 0.1% and 25% of the set-point rotation speed.

15. The pump assembly according to claim 1, wherein the amplitude of the excitation signal is computed based on a desired delivery head fluctuation, using a mathematical equation that describes the relationship between the actual rotation speed and the delivery head at the pump assembly.

* * * * *